US005816561A

United States Patent [19]

Kinsel

[11] Patent Number: 5,816,561

[45] Date of Patent: Oct. 6, 1998

[54] MOTORCYCLE JACK

[76] Inventor: Jeffrey J. Kinsel, 2912 Crater Lake Dr., Baton Rouge, La. 70814

[21] Appl. No.: 597,154

[22] Filed: Feb. 6, 1996

[51] Int. Cl.[6] ..... B66F 3/36

[52] U.S. Cl. ..... 254/100

[58] Field of Search ..... 254/45, 47, 89 R, 254/100, 98, 133

[56] References Cited

U.S. PATENT DOCUMENTS 1,113,015 10/1914 Jones ..... 254/100
2,020,991 11/1935 Brody ..... 254/100
3,279,756 10/1966 Vorpahl ..... 254/100
4,708,319 11/1987 Cruz ..... 254/45

*Primary Examiner*—Robert C. Watson
*Attorney, Agent, or Firm*—Donald H. Fidler

[57] ABSTRACT

A motorcycle jack which is compact and portable in a tow sack. The jack includes post members and cross bar pieces which can be assembled for use and disassembled for transport. Arcuate shaped tab members on tab members are disposed upon rotatable nuts on the post members which are used for elevating a motor cycle relative to the earth's surface.

4 Claims, 2 Drawing Sheets

MOTORCYCLE JACK

FIELD OF THE INVENTION

This invention relates to a vehicle jack and more particularly to a portable, compact jack which can be disassembled for transport and assembled for use in elevating motorcycles relative to the earth's surface.

BACKGROUND OF THE INVENTION

Bikers tend to travel long distances cross-country and on back trails with large and heavy motorcycles where the convenience of service and repairs is not readily available should a tire go flat. A biker will typically carry a compact repair kit and tools which includes a tire plug, an air can and tools. If a flat tire occurs away from a service location it is usually necessary to find and repair the leak at the location of the flat. There is no simple way to access a tire and it is impractical as well as undesirable to lay a cycle on its side.

While a front tire of a motorcycle is generally accessible, a rear tire can be difficult to access and locating a puncture on a tire on the ground can be extremely difficult. Irrespective, it is often necessary or desirable to raise either a front or a rear tire relative to the ground to perform a repair or inspection. In addition, should the biker desire to elevate a rear tire relative to the ground for repair it is not practical because of the weight and structure of a bike. This is particularly true in larger size bikes. Also, should the tire bead break and lose the air pressure seal it is necessary to remove the weight on the flat tire before the tire can be inflated.

SUMMARY OF THE PRESENT INVENTION

The present invention is embodied in a collapsible jack assembly which can be reduced or disassembled to a small storage size, and assembled to a jack unit or assembly which can support the weight of a cycle and can be used to jack up a cycle relative to a ground surface to rotate a rear or a front tire. The Jack includes two threaded post members with equal lengths. A cross bar unit for the jack provides a transverse weight support member and is comprised of a number of interconnected cross bar pieces. Each cross bar piece respectively has a length comparable to or less than the length of a post member. The cross bar pieces at the end of a connected cross bar unit respectively have an arcuately shaped tab member with an opening sized to receive a post member. The post members are threadedly received in base members and respectively carry an actuating nut located below a tab member.

When the post members are threaded into the base members and the cross bar pieces are assembled, the tab members respectively are received over the post members and rest on the nuts on the respective post members. In use, the post members are located to either side of the base frame of a cycle. The tab members are located on first one post and then the other post so that the cross bar is located appropriately with respect to the cycle frame. Next the nuts, located below the tab members are alternately rotated by a crescent wrench, or other tool, which elevates the cross bar unit and elevates cycle from the ground. The arcuate surface on a tab member minimizes the frictional effect and prevents binding on an actuating nut. To lower the cycle from an elevated position, the actuating nuts are rotated in an opposite direction and the cycle can be lowered to the ground after a tire is fixed. The jack then can be removed and disassembled. When disassembled, the jack components are of generally uniform length and can be bundled for storage in a tow sack for transport with other cycle tools.

DESCRIPTION OF THE INVENTION

Figure 1:
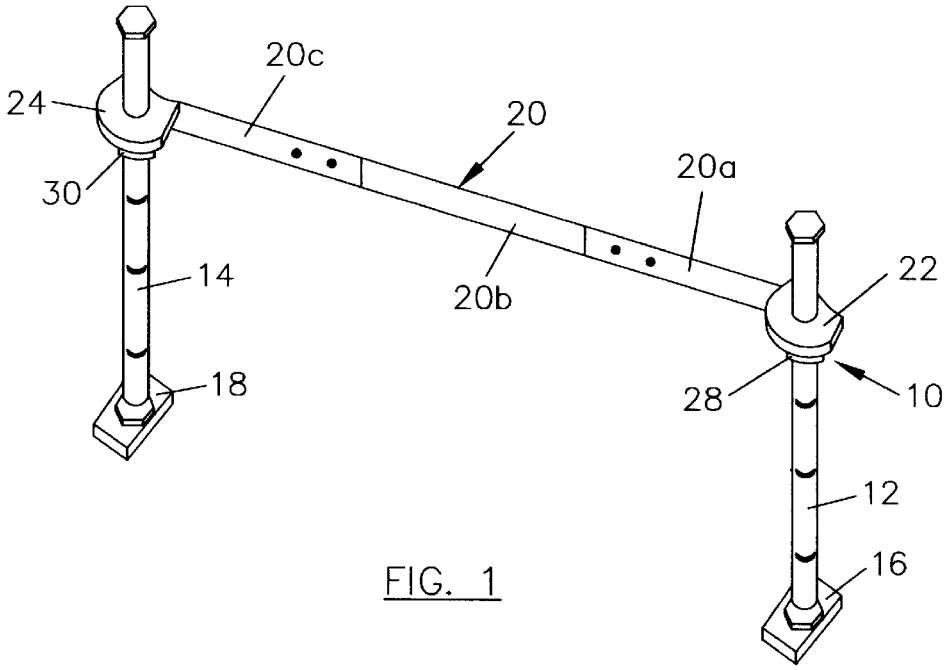
FIG. 1 is a perspective view of an assembled jack embodying the present invention.
Figure 2:
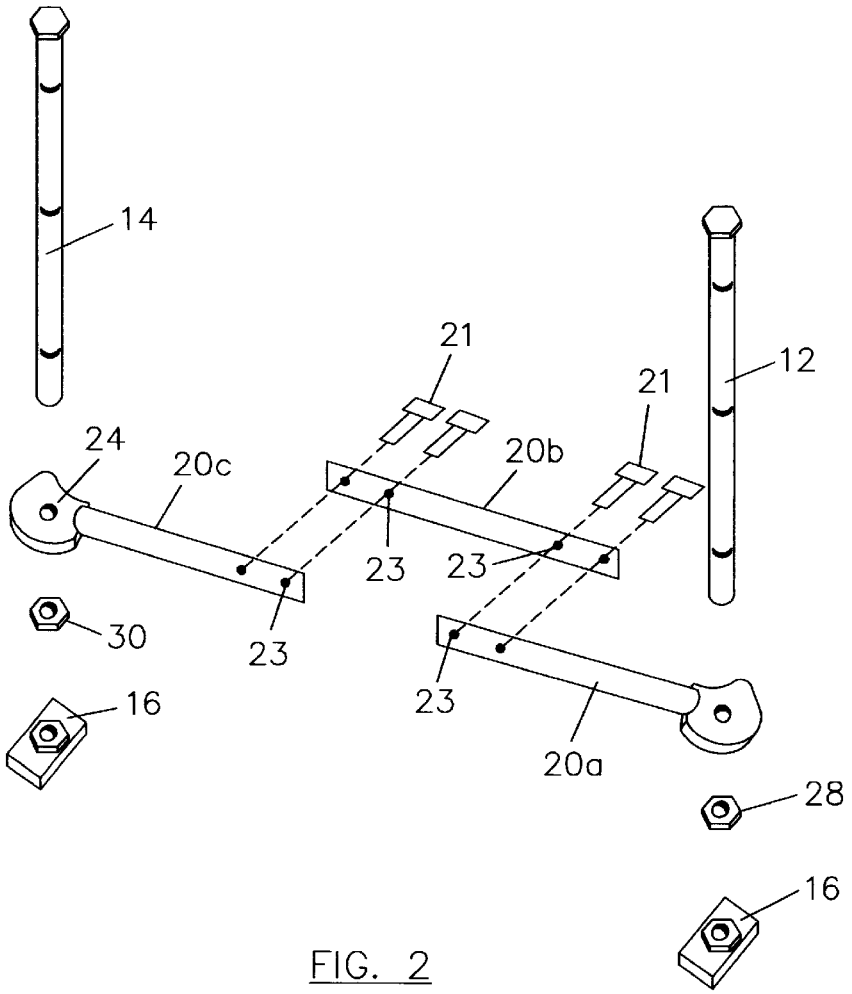
FIG. 2 is a perspective exploded view of a jack embodying the present invention.

Referring now to FIG. 1, an assembled jack 10 is illustrated. The jack 10 includes spaced apart threaded post members 12 and 14. The post members 12, 14 are respectively threadedly received in elongated base members 16, 18. A base member 16 or 18 is a rectangular plate member with an attached nut for receiving the threaded end of a post member.

A cross bar assembly 20 consists of three or more pieces of bar stock 20*a*, 20*b*, 20*c*, none of which is longer than the length of a post member 12 or 14. The adjacent ends of cross bar pieces are connected by removable bolts 21 which extend through aligned bores 23 in the cross bars and provide a rigid, strength bearing interconnection.

Figure 4:
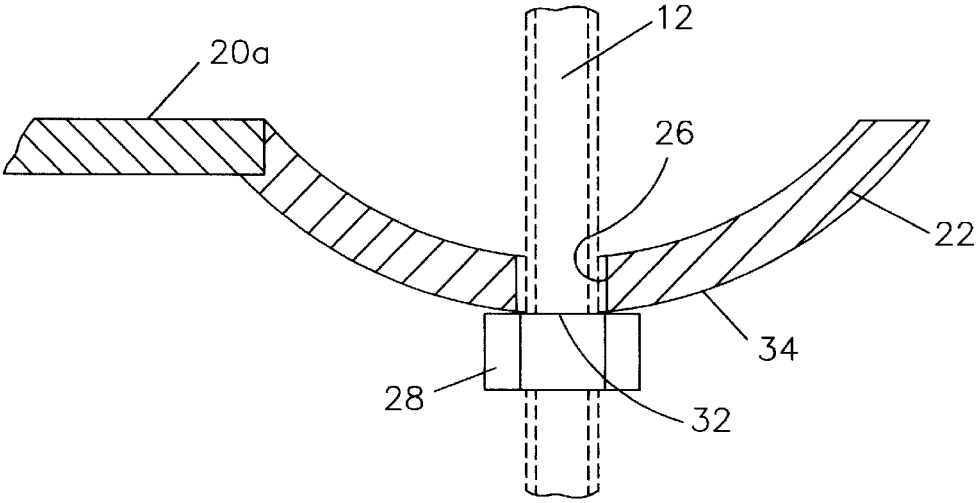
FIG. 4 is a partial view in cross-section through a tab member.

The ends of an outer cross bar piece 20*a* and 20*c* have an arcuately shaped tab member 22, 24 (See FIG. 4) which has an opening 26 sized to receive a post member and to permit canting of the opening relative to a post member. Each post member 22, 24 has an actuating nut 28, 30 located below a tab member. An actuating nut is threaded on a post member and has a line contact 32 (See FIG. 4) with the underside surface of a tab member. When an actuating nut is rotated, it moves lengthwise of a post member, and the curvature of the underside surface 34 of a tab member permits the movement while minimizing frictional binding.

By way of example and not limitation, a post member can be a ½" standard threaded rod between 6" and 10½" in length. A cross piece can be ¼"×1" cold rolled steel. The curvature of the surface is based upon a 2" radius. This dimensioning is satisfactory for a Harley Electric Guide cycle, for example, and will elevate the cycle 1" off the ground. The cross bars when assembled can have an overall length of 22 inches. The dimensioning is, of course, a relative function of the width of the cycle to be spanned and the distance of the cycle base to be elevated from the ground surface.

Figure 3:
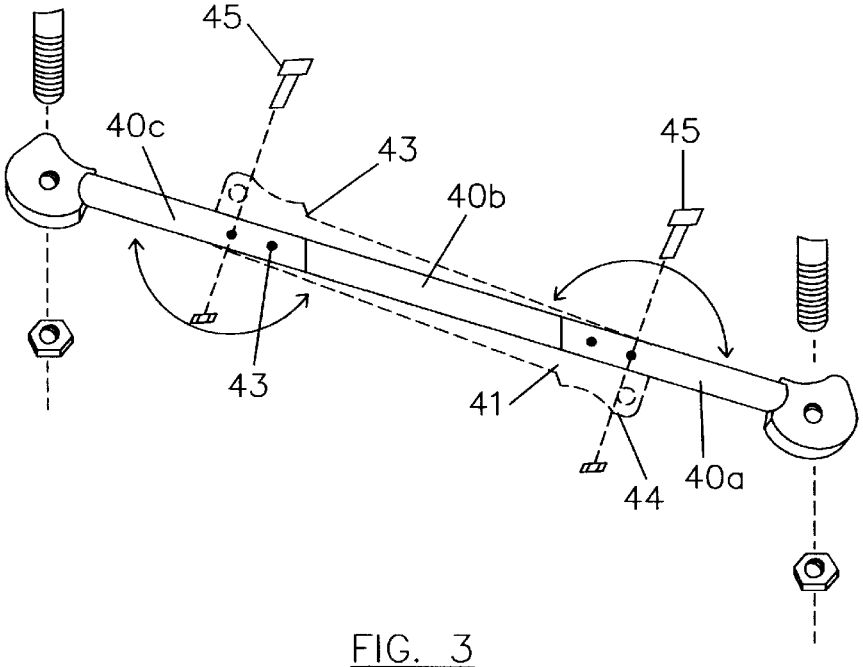
FIG. 3 is a partial view of a modification of the cross piece unit.

Referring now to FIG. 3, a modified cross bar arrangement is illustrated where cross bar pieces 40*a*, 40*b*, and 40*c* are pivotally connected to one another with pivot pins 41, 43 so that they can be retained in a single assembly piece. As illustrated, one cross piece 40*a* can be pivoted relative to the center cross piece 40*b* to the dashed line position 43 illustrated while the other cross piece 40*c* can also be pivoted relative to the center cross 40*b* to a dashed line position 44. In a folded up condition, the cross pieces are in a position for transport. In an extended condition of the cross pieces 40*a*, 40*b*, 40*c*, pins or bolts 45 can be inserted into aligned openings to provide a rigid assembly.

It will be appreciated that the cross-pieces can be pivoted or can be interconnected for relative sliding movement with a tongue and groove or can be independently assembled as shown in FIG. 1.

It will be apparent to those skilled in the art that various changes may be made in the invention without departing from the spirit and scope thereof and therefore the invention is not limited by that which is disclosed in the drawings and specifications but only as indicated in the appended claims.

I claim:

1. A motorcycle jack for raising and lowering a motorcycle where such jack can be assembled for use and disassembled for transport on the motorcycle, said jack including:

a pair of elongated threaded post members for providing a vertical non-rotating support on either side of a motorcycle;

two or more elongated cross bar pieces for providing a transverse support member unit, each of said cross bar pieces having a length similar to the length of a post member, so that said cross bar pieces and said post members can be neatly packed for transport, said cross bar pieces being separable from said post members upon disassembly;

means for releasably interconnecting said cross bar pieces in a rigid assembly mode;

at least two of said cross bar pieces having terminal ends with attached tab members where said tab members have bore openings sized to receive said post members without binding; and actuating nut means locatable on said post members below a tab member for rotation on said post members for moving said cross bar pieces in said rigid assembly mode up and down relative to said non-rotating post members.

2. The motorcycle jack as set forth in claim 1 wherein said tab members have an arcuate curvature so that the contact surface with a nut means is limited to a minimum to enable rotation of a nut means about post member.

3. The motorcycle jack as set forth in claim 2 wherein said cross bar pieces range in length between 6 and 11 inches approximately.

4. The motorcycle jack as set forth in claim 2 wherein said means for releasably interconnecting said cross bar pieces includes bolt members.

* * * * *